United States Patent [19]

Uemura et al.

[11] Patent Number: 4,985,397

[45] Date of Patent: Jan. 15, 1991

[54] THERMAL IMAGE TRANSFER RECORDING SYSTEM

[75] Inventors: Hiroyuki Uemura, Numazu; Akira Suzuki, Mishima; Masaru Shimada, Shizuoka; Hidehiro Mochizuki; Naoya Morohoshi, both of Numazu, all of Japan

[73] Assignee: Ricoh Company, Ltd., Tokyo, Japan

[21] Appl. No.: 558,296

[22] Filed: Jul. 26, 1990

Related U.S. Application Data

[63] Continuation-in-part of Ser. No. 405,480, Sep. 12, 1989.

[30] Foreign Application Priority Data

| | | | |
|---|---|---|---|
| Oct. 3, 1988 | [JP] | Japan | 63-249458 |
| Jul. 31, 1989 | [JP] | Japan | 1-200098 |
| Oct. 12, 1989 | [JP] | Japan | 1-265799 |

[51] Int. Cl.[5] ..... B41M 5/035; B41M 5/26

[52] U.S. Cl. ..... 503/227; 8/471; 428/195; 428/341; 428/412; 428/423.1; 428/447; 428/480; 428/500; 428/522; 428/913; 428/914

[58] Field of Search ..... 8/471; 428/195, 341, 428/412, 423.1, 447, 480, 500, 522, 913, 914

[56] References Cited

U.S. PATENT DOCUMENTS 3,820,686 4/1989 Ito et al. ..... 503/227

*Primary Examiner*—Bruce H. Hess

*Attorney, Agent, or Firm*—Oblon, Spivak, McClelland, Maier & Neustadt

[57] ABSTRACT

A thermal image transfer recording system comprises a sublimation type thermal image transfer recording medium in combination with an image receiving medium comprising a substrate and a dye receiving layer formed thereon, which comprises, as the principal components, (1) a vinyl chloride-based resin containing active hydrogens and (2) an isocyanate compound.

16 Claims, No Drawings

THERMAL IMAGE TRANSFER RECORDING SYSTEM

This application is a continuation-in-part of application Ser. No. 07/405,480, filed Sept. 12, 1989.

BACKGROUND OF THE INVENTION

1. Field of the Invention

This invention relates to a thermal image transfer system, comprising a sublimation type thermal image transfer recording medium in combination with an image receiving medium comprising a substrate and a dye receiving layer formal thereon, the dye receiving layer comprising, as the principal components, a vinyl chloride-based resin containing active hydrogens and an isocyanate compound.

2. Discussion of Background

Recently the demand for full color printers is increasing year by year. Typical recording methods for full color printers now available include the electrophotographic method, the ink-jet method, and the thermosensitive image transfer method. Of these methods, the thermosensitive image transfer method is most widely employed because of its advantages over the other methods in that the maintenance is easy and the operation is noiseless.

In the thermosensitive image transfer recording method, a solidified color ink sheet and an image receiving sheet are employed, and a color ink is transferred imagewise from the ink sheet to the receiving sheet by the thermal fusion or the sublimation of the ink, under the application of thermal energy by laser beams or a thermal head which is controlled by electric signals.

Thus, the thermosensitive image transfer recording method can be roughly classified into two types, a thermal fusing image transfer type and a sublimation image transfer type. The sublimation image transfer type is advantageous over the thermal fusing type in that halftone can be obtained without difficulty and image gradation can be controlled as desired. These benefits exist because a sublimable dye is in principle sublimated in the form of independent molecules in such an amount as to correspond to the amount of thermal energy applied thereto, for instance, through a thermal head. Therefore, the sublimation image transfer type is considered the most suitable for color printers.

As the sublimation image transfer recording method, there have been known (i) an n-times use mode recording method in which the running speed of the image receiving sheet is made n ($n>1$) times the running speed of the ink sheet when images are recorded, (ii) an area-sequential recording method which uses a line head and (iii) a line-sequential recording method which uses a serial head as a thermal head.

Hitherto, there has been employed, in the sublimation-type thermal image transfer recording method, an image receiving sheet which consists of a substrate (paper, synthetic paper, plastic film, etc.) and a dye receiving layer formed thereon containing as its main component a thermoplastic resin, such as polyester resin, which can be well dyed with a sublimation-type dye.

The above image receiving sheet, however, cannot be smoothly released from the ink sheet after the thermal image transfer recording is completed. Especially, when the n-times use mode recording method is employed, the ink sheet and the image receiving sheet are strongly frictionized each other when images are recorded, so that these two sheets tend to stick to each other or to be damaged.

SUMMARY OF THE INVENTION

Accordingly, it is an object of the present invention to provide a thermal image transfer recording system, comprising a sublimation type thermal image transfer recording medium in combination with an image receiving medium, which can be employed even in the n-times uses mode recording method which requires high releasability between the image transfer recording medium and the image receiving medium.

The above object of the present invention can be attained by a thermal image transfer recording system comprising a sublimation-type thermal image transfer recording medium in combination with an image receiving medium, comprising a substrate, and a dye receiving layer formed thereon, which dye receiving layer comprises as the principal main components (1) a vinyl chloride-based resin containing active hydrogens and (2) and isocyanate compound.

DETAILED DESCRIPTION OF THE PREFERRED EMBODIMENTS

The image receiving medium for use in the present invention comprises a substrate and a dye receiving layer formed thereon, the dye receiving layer comprising as the principal components a vinyl chloride-based resin containing active hydrogens, and an isocyanate compound. The vinyl chloride-based resin imparts high dye-receptivity, releasability, light-resistance and preservability to the image receiving medium. Furthermore, the vinyl chloride-based resin is hardened when reacted with the isocyanate compound, so that the releasability of the dye receiving layer from a sublimation type thermal transfer recording medium is improved.

In the present invention, it is preferable to further incorporate a polyester resin into the dye receiving layer. This is because the polyester resin can also impart the dye-receptivity, releasability, light-resistance and preservability to the image receiving medium. In this case, the amount of the polyester resin is 50 to 100 parts by weight per 100 parts by weight of the vinyl chloride-based resin containing active hydrogens.

Examples of the vinyl chloride-based resin containing active hydrogens for use in the present invention include vinyl chloride-vinyl acetate copolymers modified with polyvinyl alcohol. Commercially available products of such copolymers are, for example, "VAGH" and "VROH" (Trademarks) made by Union Carbide Japan K.K.; and "Denka Vinyl 1000GKT", "Denka Vinyl 1000GK" and "Denka Vinyl 1000GKS" (Trademarks) made by Denki Kagaku Kogyo K.K.

Examples of the isocyanate compound for use in the present invention include tolylene diisocyanate, hexamethylene diisocyanate, 4,4-diphenylmethane diisocyanate, triphenylmethane triisocyanate, and addition products of hexatriol with the above compounds.

It is preferable that the vinyl chloride-based resin containing active hydrogens and the isocyanate compound be employed in such an amount ratio that the molar ratio of the NCO groups in the isocyanate compound to the groups having an active hydrogen, such as an OH group and a COOH group, in the vinyl chloride-based resin, is 0.2 to 2.0.

Conventionally known dye-receptive resins such as polycarbonate resin, styrene resin, vinyl chloride resin other than the above vinyl chloride-based resin, and silicone resin may be additionally incorporated into the dye receiving layer in the present invention, if necessary.

Of these resins, the vinyl chloride resin is most preferable. Examples of commercially available vinyl chloride resins, which can be employed in the present invention, include "VYHH", "VYNS", "VYHD" and "VYLF" (Trademarks) made by Union Carbide Japan K.K.; and "Denka Vinyl 1000MT", "Denka Vinyl 1000A", "Denka Vinyl 1000L", "Denka Vinyl 1000D", "Denka Vinyl MHE100" and "Denka Vinyl ME120" (Trademarks) made by Denki Kagaku Kogyo K.K.

When any of the above resins is employed, its preferred amount is 0.1 to 1 time the amount of the vinyl chloride-based resin containing active hydrogens in the dye receiving layer.

A silicone which can serve as a releasing agent, such as amino-modified silicone, epoxy-modified silicone or alkyd-modified silicone, may also be incorporated into the dye receiving layer in the present invention. When such a silicone is employed, the image receiving medium can peel off the image transfer recording medium more easily after thermal recording is completed. The incorporation amount of the silicone is preferably 10 wt. % or less of the total weight of the vinyl chloride-based resin containing active hydrogens, and the resin components contained in the dye receiving layer.

Furthermore, a filler, for example, a white pigment such as silica, titanium oxide or calcium carbonate, may be incorporated into the dye receiving layer. The incorporation amount of the filler is preferably 5 to 60 wt. % of the total weight of the vinyl chloride-based resin containing active hydrogens, and the resin components contained in the dye receiving layer.

In addition, auxiliary components such as a surface active agent, an ultraviolet ray-absorber, and an antioxidant may be incorporated into the dye receiving layer, if necessary.

As the substrate on which the dye receiving layer is formed, synthetic papers such as high quality paper and cellulose fiber paper, coated papers such as art paper, gravure coated paper and baryta paper, and plastic films such as a polyethylene terephthalate film (PET film) can be used either singly or in a laminated combination. Of these, a PFT film, in particular, a white PET film containing white particles, is most preferred. The PET film has a relatively high hardness, and the dye receiving layer is also hard. Therefore, the images formed in the dye receiving layer on the PET film, even when produced by application of a large amount of energy, have a smooth surface. Thus, images with high glossiness can be obtained even in a high image density area.

It is preferably that the thickness of the substrate be in the range of 50 to 200 μm. The coating amount of the solid components of the dye receiving layer on the substrate is preferably 0.1 to 20 g/m$^2$.

As the sublimation type thermal transfer recording medium in combination with the above image receiving medium in the thermal image transfer recording system according to the present invention, any conventional sublimation type recording media can be employed, which comprises, for instance, a substrate, and a dye supplying layer formed on the substrate, the dye supplying layer comprising a sublimable dye and a binder agent in which the sublimable dye is dissolved or dispersed.

Other features of this invention will become apparent in the course of the following description of exemplary embodiments, which are given for illustration of the invention and are not limiting thereof.

EXAMPLE A-1

The following components were thoroughly dispersed to obtain a liquid A for the formation of a dye receiving layer.

Formulation of Liquid A

| | parts by weight |
|---|---|
| Copolymer of vinyl chloride/vinyl acetate/vinyl alcohol (Trademark "VAGH" made by Union Carbide Japan K.K.) | 10 |
| Isocyanate (Trademark "Coronate L" made by Nippon Polyurethane Industry Co., Ltd.) | 5 |
| Amino-modified silicone (Trademark "SF-8417" made by Toray Silicone Co., Ltd.) | 0.5 |
| Epoxy-modified silicone (Trademark "SF-8411" made by Toray Silicone Co., Ltd.) | 0.5 |
| Toluene | 40 |
| Methyl ethyl ketone | 40 |

The above-prepared liquid A was coated, using a wire bar, onto a synthetic paper (Trademark "Yupo FPG-150" made by Oji-Yuka Synthetic Paper Co., Ltd.) serving as a substrate, having a thickness of approximately 150 μm, and dried at 75° C. for one minute, thereby forming a dye receiving layer with a thickness of approximately 5 μm on the paper. The dye receiving layer was then allowed to stand at 80° C. for three hours so as to harden the dye receiving layer. Thus, an image receiving medium No. A-1 for use in the present invention was obtained.

A liquid B for the formation of an ink layer (a dye transfer layer) having the following formulation was prepared. It was then coated on a 6 μm thick PET film backed with a silicone hardened resin layer having a thickness of approximately 1 μm, serving as a substrate, thereby forming an ink layer having a thickness of approximately 2 μm on the film. Thus, an image transfer recording medium was obtained.

Formulation of Liquid B

| | parts by weight |
|---|---|
| Polyvinyl butyral (Trademark "BX-1" made by Sekisui Chemical Co., Ltd.) | 10 |
| Dispersion of sublimation-type dye for cyan (Trademark "Kayaset 714" made by Nippon Kayaku Co., Ltd.) | 6 |
| Methyl ethyl ketone | 45 |
| Toluene | 45 |

The above-prepared image transfer recording medium was superposed on the image receiving medium No. A-1 so that the ink layer of the image transfer recording medium faced the dye receiving layer of the image receiving medium. Thermal energy was applied to the substrate of the image transfer recording medium by a thermal head, and an image recording test was carried out by changing the energy levels. In the above test, the running speed ratio "n" of the image receiving medium to the image transfer recording medium was adjusted to 10. The recording density of the thermal head was 6 dot/mm, and the recording power was 0.42 W/dot.

EXAMPLE A-2

The procedure for Example A-1 was repeated except that the liquid A employed in Example A-1 was replaced with a liquid C having the following formulation, whereby an image receiving medium No. A-2 for use in the present invention was prepared.

Formulation of Liquid C

| | parts by weight |
|---|---|
| Copolymer of vinyl chloride/ vinyl acetate/vinyl alcohol (Trademark "VAGH" made by Union Carbide Japan K.K.) | 7 |
| Copolymer of vinyl chloride/ vinyl acetate (Trademark "VYHH" made by Union Carbide Japan K.K.) | 7 |
| Isocyanate (Trademark "Coronate L" made by Nippon Polyurethane Industry Co., Ltd.) | 3 |
| Amino-modified silicone (Trademark "SF-8417" made by Toray Silicone Co., Ltd.) | 0.5 |
| Epoxy-modified silicone (Trademark "SF-8411" made by Toray Silicone Co., Ltd.) | 0.5 |
| Toluene | 40 |
| Methyl ethyl ketone | 40 |

By using the image receiving medium No. A-2 and the image transfer recording medium prepared in Example A-1, an image recording test was carried out in the same manner as in Example A-1.

COMPARATIVE EXAMPLE A-1

The procedure for Example A-1 was repeated except that the liquid A employed in Example A-1 was replaced with a liquid D having the following formulation, whereby b comparative image receiving medium No. A-1 was prepared.

Formulation of Liquid D

| | parts by weight |
|---|---|
| Polyester resin (Trademark "Vylon 200" made by Toyobo Co., Ltd.) | 10 |
| Amino-modified silicone (Trademark "SF-8417" made by Toray Silicone Co., Ltd.) | 0.1 |
| Epoxy-modified silicone (Trademark "SF-8411" made by Toray Silicone Co., Ltd.) | 0.1 |
| Toluene | 40 |
| Methyl ethyl ketone | 40 |

By using the comparative image receiving medium No. A-1 and the image transfer recording medium prepared in Example A-1, an image recording test was carried out in the same manner as in Example A-1.

COMPARATIVE EXAMPLE A-2

The procedure for Example A-1 was repeated except that the liquid A employed in Example A-1 was replaced with a liquid E having the following formulation, whereby a comparative image receiving medium No. A-2 was prepared.

Formulation of Liquid E

| | parts by weight |
|---|---|
| Copolymer of vinyl chloride/ vinyl acetate (Trademark "VYHH" made by Union Carbide Japan K.K.) | 10 |
| Amino-modified silicone (Trademark "SF-8417" made by Toray Silicone Co., Ltd.) | 0.1 |
| Epoxy-modified silicone (Trademark "SF-8411" made by Toray Silicone Co., Ltd.) | 0.1 |
| Toluene | 40 |
| Methyl ethyl ketone | 40 |

By using the comparative image receiving medium No. A-2 and the image transfer recording medium prepared in Example A-1, an image recording test was carried out in the same manner as in Example A-1.

After the image recording tests, the surfaces of the image transfer recording media and the image receiving media were visually observed. The results are shown in Table 1.

TABLE 1

| | |
|---|---|
| Example A-1 | No problems were found on the surfaces of the two media |
| Example A-2 | No problems were found on the surfaces of the two media |
| Comparative Example A-1 | The transfer recording medium was fused and sticked to the image receiving medium and collapsed |
| Comparative Example A-2 | The transfer recording medium was fused and sticked to the image receiving medium and collapsed |

EXAMPLE B-1

The following components were thoroughly dispersed to obtain a liquid F for the formation of a dye receiving layer.

Formulation of Liquid F

| | parts by weight |
|---|---|
| Copolymer of vinyl chloride/ vinyl acetate/vinyl alcohol (Trademark "VAGH" made by Union Carbide Japan K.K.) | 10 |
| Polyester resin (Trademark "Vylon 200" made by Toyobo Co., Ltd.) | 5 |
| Isocyanate (Trademark "Coronate L" made by Nippon Polyurethane Industry Co., Ltd.) | 5 |
| Amino-modified silicone (Trademark "SF-8417" made by Toray Silicone Co., Ltd.) | 0.5 |
| Epoxy-modified silicone (Trademark "SF-8411" made by Toray Silicone Co., Ltd.) | 0.5 |
| Toluene | 40 |
| Methyl ethyl ketone | 40 |

The above-prepared liquid F was coated, using a wire bar, onto a synthetic paper (Trademark "Yupo FPG-150" made by Oji-Yuka Synthetic Paper Co., Ltd.) serving as a substrate, having a thickness of approximately 150 μm, and dried at 75° C. for one minute, thereby forming a dye receiving layer with a thickness of approximately 5 μm on the paper. The dye receiving layer was then allowed to stand at 80° C. for three hours so as to harden the dye receiving layer. Thus, an image receiving medium No. B-1 for use in the present invention was obtained.

A liquid G for the formation of an ink layer (a dye transfer layer) having the following formulation was prepared. It was then coated on a 6 μm thick PET film backed with a silicone hardened resin layer having a thickness of approximately 1 μm, serving as a substrate, thereby forming an ink layer with a thickness of approximately 2 μm on the film. Thus, an image transfer recording medium was obtained.

Formulation of Liquid G

| | parts by weight |
|---|---|
| Polyvinyl butyral (Trademark "BX-1" made by Sekisui Chemical Co., Ltd.) | 10 |
| Dispersion of sublimation-type dye for cyan (Trademark "Kayaset 714" made by Nippon Kayaku Co., Ltd.) | 6 |
| Polyethylene wax (Trademark "320P" made by Mitsui Petrochemical Industries, Ltd.) | 3 |
| Methyl ethyl ketone | 90 |
| Toluene | 90 |

The above-prepared image transfer recording medium was superposed on the image receiving medium No. B-1 so that the ink layer of the image transfer recording medium faced the dye receiving layer of the image receiving medium. Thermal energy was applied to the substrate of the image transfer recording medium by a thermal head, and an image recording test was carried out by changing the energy levels. In the above test, the running speed ratio "n" of the image receiving medium to the image transfer recording medium was adjusted to 10. The recording density of the thermal head was 6 dot/mm, and the recording power was 0.42 W/dot.

EXAMPLE B-2

The procedure for Example B-1 was repeated except that the liquid F employed in Example B-1 was replaced with a liquid H having the following formulation, whereby an image receiving medium No. B-2 according to the present invention was prepared.

Formulation of Liquid H

| | parts by weight |
|---|---|
| Copolymer of vinyl chloride/vinyl acetate/vinyl alcohol (Trademark "VAGH" made by Union Carbide Japan K.K.) | 7 |
| Copolymer of vinyl chloride/vinyl acetate (Trademark "VYHH" made by Union Carbide Japan K.K.) | 7 |
| Polyester resin (Trademark "Vylon 290" made by Toyobo Co., Ltd.) | 7 |
| Isocyanate (Trademark "Coronate L" made by Nippon Polyurethane Industry Co., Ltd.) | 3 |

-continued

| | parts by weight |
|---|---|
| Amino-modified silicone (Trademark "SF-8417" made by Toray Silicone Co., Ltd.) | 0.5 |
| Epoxy-modified silicone (Trademark "SF-8411" made by Toray Silicone Co., Ltd.) | 0.5 |
| Toluene | 40 |
| Methyl ethyl ketone | 40 |

By using the image receiving medium No. B-2 and the image transfer recording medium prepared in Example B-1, an image recording test was carried out in the same manner as in Example B-1.

COMPARATIVE EXAMPLE B-1

The procedure for Example B-1 was repeated except that the liquid F employed in Example B-1 was replaced with the liquid D employed in Comparative Example A-1, whereby a comparative image receiving medium No. B-1 was prepared.

By using the comparative image receiving medium No. B-1 and the image transfer recording medium prepared in Example B-1, an image recording test was carried out in the same manner as in Example B-1.

COMPARATIVE EXAMPLE B-2

The procedure for Comparative Example B-1 was repeated except that the liquid D employed in Comparative Example B-1 was replaced with the liquid E employed in Comparative Example A-2, whereby a comparative image receiving medium No. B-2 was prepared.

By using the comparative image receiving medium No. B-2 and the image transfer recording medium prepared in Example B-1, an image recording test was carried out in the same manner as in Example B-1.

After the image recording tests, the surfaces of the image transfer recording media and the image receiving media were visually observed. The results are shown in Table 2.

TABLE 2

| | |
|---|---|
| Example B-1 | No problems were found on the surfaces of the two media |
| Example B-2 | No problems were found on the surfaces of the two media |
| Comparative Example B-1 | The transfer recording medium was fused and sticked to the image receiving medium and collapsed |
| Comparative Example B-2 | The transfer recording medium was fused and sticked to the image receiving medium and collapsed |

EXAMPLE C-1

The liquid A for the formation of a dye receiving layer prepared in Example A-1 was coated, using a wire bar, onto a white PET film (Trademark "Merinex 329" made by Imperial Chemical Industries, Ltd.), serving as a substrate, having a thickness of approximately 150 μm, and dried at 75° C. for one minute, thereby forming a dye receiving layer with a thickness of approximately 5 μm on the paper. The dye receiving layer was then allowed to stand at 80° C. for three hours so as to harden the dye receiving layer. Thus, an image receiving medium No. C-1 for use in the present invention was obtained.

The liquid B for the formation of an ink layer (a dye transfer layer) prepared in Example A-1 was then coated on a 6 μm thick PET film backed with a silicone hardened resin layer having a thickness of approximately 1 μm, serving as a substrate, thereby forming an ink layer having a thickness of approximately 2 μm on the film. Thus, an image transfer recording medium was obtained.

The above-prepared image transfer recording medium was superposed on the image receiving medium No. C-1 so that the ink layer of the image transfer recording medium faced the dye receiving layer of the image receiving medium. Thermal energy was applied to the substrate of the image transfer recording medium by a thermal head, and an image recording test was carried out by changing the energy levels. In the above test, the running speed ratio "n" of the image receiving medium to the image transfer recording medium was adjusted to 10. The recording density of the thermal head was 6 dot/mm, and the recording power was 0.42 W/dot.

EXAMPLE C-2

The procedure for Example C-1 was repeated except that the white PET film used in Example C-1 was replaced with a substrate consisting of a sheet of synthetic paper with a thickness of approximately 60 μm, a sheet of coated paper with a thickness of approximately 50 μm and a white PET film with a thickness of 60 μm, whereby an image receiving medium No. C-2 according to the present invention was prepared. It should be noted that the dye receiving layer was formed on the white PET film in the substrate.

By using the image receiving medium No. C-2 and the image transfer recording medium prepared in Example C-1, an image recording test was carried out in the same manner as in Example C-1.

COMPARATIVE EXAMPLE C-1

The procedure for Example C-1 was repeated except that the liquid A employed in Example C-1 was replaced with the liquid D prepared in Comparative Example A-1, whereby a comparative image receiving medium No. C-1 was prepared.

By using the comparative image receiving medium No. C-1 and the image transfer recording medium prepared in Example C-1, an image recording test was carried out in the same manner as in Example C-1.

COMPARATIVE EXAMPLE C-2

The procedure for Comparative Example C-1 was repeated except that the liquid D employed in Comparative Example C-1 was replaced with the liquid E prepared in Comparative Example A-2, whereby a comparative image receiving medium No. C-2 was prepared.

By using the comparative image receiving medium No. C-2 and the image transfer recording medium prepared in Example C-1, an image recording test was carried out in the same manner as in Example C-1.

After the image recording tests, the surfaces of the image transfer recording media and the image receiving media were visually observed. The results are shown in Table 3.

TABLE 3

| | |
|---|---|
| Example C-1 | No problems were found on the surfaces of the two media |

TABLE 3-continued

| | |
|---|---|
| Example C-2 | No problems were found on the surfaces of the two media |
| Comparative Example C-1 | The transfer recording medium was fused and sticked to the image receiving medium and collapsed |
| Comparative Example C-2 | The transfer recording medium was fused and sticked to the image receiving medium and collapsed |

What is claimed is:

1. A thermal image transfer recording system, comprising:

a sublimation type thermal image transfer recording medium in combination with an image receiving medium comprising a substrate and a dye receiving layer formed thereon, said dye receiving layer comprising, as the principal components, (1) a vinyl chloride-based resin containing active hydrogens and (2) an isocyanate compound.

2. The thermal image transfer recording system as claimed in claim 1, wherein said dye receiving layer of said image receiving medium further comprises a polyester resin.

3. The thermal image transfer recording system as claimed in claim 1, wherein the amount of said polyester resin in said dye receiving layer is 50 to 100 parts by weight per 100 parts by weight of said vinyl chloride-based resin.

4. The thermal image transfer recording system as claimed in claim 1, wherein said vinyl chloride-based resin containing active hydrogens in said image receiving layer is a vinyl chloride-vinyl acetate copolymer modified with polyvinyl alcohol.

5. The thermal image transfer recording system as claimed in claim 1, wherein said isocyanate compound is selected from the group consisting of tolylene diisocyanate, hexamethylene diiso-cyanate, 4,4-diphenylmethane diisocyanate, triphenylmethane triisocyanate, and addition products of hexatriol with any of said isocyanate compounds.

6. The thermal image transfer recording system as claimed in claim 1, wherein the amount ratio of said vinyl chloride-based resin to said isocyanate compound is such that the molar ratio of the NCO groups in said isocyanate compound to the groups having an active hydrogen in said vinyl chloride-based resin is in the range of 0.2 to 2.0.

7. The thermal image transfer recording system as claimed in claim 1, wherein said substrate comprises a polyethylene terephthalate film.

8. The thermal image transfer recording system as claimed in claim 1, wherein the coating amount of said dye receiving layer onto said substrate is 0.1 to 20 $g/m^2$ in terms of the solid components thereof.

9. The thermal image transfer recording system as claimed in claim 1, wherein said dye receiving layer further comprises a resin which can be dyed with a sublimation-type dye.

10. The thermal image transfer recording system as claimed in claim 9, wherein said resin is selected from the group consisting of polycarbonate resin, styrene resin, vinyl chloride resin and silicone resin.

11. The thermal image transfer recording system as claimed in claim 9, wherein said resin is vinyl chloride resin.

12. The thermal image transfer recording system as claimed in claim 9, wherein the amount of said resin is 0.1 to 1 time that of said vinyl chloride-based resin containing active hydrogens.

13. The thermal image transfer recording system as claimed in claim 1, wherein said dye receiving layer of said image receiving medium further comprises a silicone selected from the group consisting of amino-modified silicone, expoxy-modified silicone and alkyd-modified silicone.

14. The thermal image transfer recording system as claimed in claim 13, wherein the amount of said silicone is 10 wt. % or less of the total weight of said vinyl chloride-based resin containing active hydrogens and other resin components contained in said dye receiving layer.

15. The thermal image transfer recording system as claimed in claim 1, wherein said dye receiving layer of said image receiving medium further comprises a filler selected from the group consisting of silica, titanium oxide and calcium carbonate.

16. The thermal image transfer recording system as claimed in claim 15, wherein the amount of said filler is 5 to 60 wt. % of the total weight of said vinyl chloride-based resin containing active hydrogens and other resin components contained in said dye receiving layer.

* * * * *

UNITED STATES PATENT AND TRADEMARK OFFICE

CERTIFICATE OF CORRECTION

PATENT NO. : 4,985,397

DATED : January 15, 1991

INVENTOR(S) : Hiroyuki Uemura et al

It is certified that error appears in the above-identified patent and that said Letters Patent is hereby corrected as shown below:

| Col. | Line | |
|---|---|---|
| 2 | 1 | delete "strongly frictionized" and insert --in strong frictional contact with--; |
| 2 | 11 | delete "uses" and insert --use--; |
| 2 | 22 | delete "and" (second occurrence) and insert --an--; |
| 5 | 44 | delete "b" and insert --a--; |
| 6 | 33 and 35 | delete "sticked" (both occurrences) and insert --stuck-- |
| 8 | 49 and 52 | delete "sticked" (both occurrences) and insert --stuck-- |
| 10 | 5 and 8 | delete "sticked" (both occurrences) and insert --stuck--. |
| 10 | 38 | delete "diiso-cyanate" and insert --diisocyanate--. |

Signed and Sealed this

Eighth Day of December, 1992

*Attest:*

DOUGLAS B. COMER

*Attesting Officer*

*Acting Commissioner of Patents and Trademarks*